US008201368B2

(12) United States Patent
Nirel et al.

(10) Patent No.: US 8,201,368 B2
(45) Date of Patent: Jun. 19, 2012

(54) BLIND FRAME FOR A WINDOW OR A DOOR

(75) Inventors: Roman Nirel, Jerusalem (IL); Levi Dabuoush, Gan Yavne (IL)

(73) Assignee: Alluwinner Ltd, Kfar Saba (IL)

( * ) Notice: Subject to any disclaimer, the term of this patent is extended or adjusted under 35 U.S.C. 154(b) by 321 days.

(21) Appl. No.: 12/280,558

(22) PCT Filed: Feb. 26, 2007

(86) PCT No.: PCT/IL2007/000250

§ 371 (c)(1),
(2), (4) Date: Aug. 25, 2008

(87) PCT Pub. No.: WO2007/096888

PCT Pub. Date: Aug. 30, 2007

(65) Prior Publication Data

US 2009/0255196 A1 Oct. 15, 2009

(30) Foreign Application Priority Data

Feb. 26, 2006 (IL) ..... 173940

(51) Int. Cl.

| | |
|---|---|
| ***E06B 1/04*** | (2006.01) |
| ***E06B 3/96*** | (2006.01) |
| ***E04C 2/38*** | (2006.01) |

(52) U.S. Cl. ..... 52/213; 52/217; 52/204.56; 52/204.62; 52/204.7; 52/656.4; 52/656.5; 52/656.6; 52/745.15

(58) Field of Classification Search ..... 52/213, 52/217, 204.56, 204.62, 204.7, 656.4, 656.5, 52/656.6, 745.15

See application file for complete search history.

(56) References Cited

U.S. PATENT DOCUMENTS

| | | | | |
|---|---|---|---|---|
| 3,950,902 | A * | 4/1976 | Stout | 52/91.2 |
| 5,673,739 | A * | 10/1997 | Brutsaert | 160/22 |
| 6,041,561 | A * | 3/2000 | LeBlang | 52/234 |
| 6,502,356 | B2 * | 1/2003 | Emek | 52/204.72 |
| 6,530,184 | B1 * | 3/2003 | Emek | 52/204.591 |
| 6,874,286 | B2 * | 4/2005 | Tavivian | 52/217 |
| 2003/0046885 | A1 * | 3/2003 | Tavivian | 52/204.1 |

* cited by examiner

*Primary Examiner* — Mark Wendell
(74) *Attorney, Agent, or Firm* — Deborah Gador

(57) ABSTRACT

A blind frame for a window or door, the blind frame including a channel defined by the blind frame, the channel extending at least partially around the periphery of the blind frame and defining a space between the frame and an adjacent wall, the space being adapted and configured to receive an amount of concrete so as to affix the frame to the wall. The blind frame may include an accessory compartment including a housing defining an external surface adapted and configured to support an amount of concrete and embed said housing in said wall opening.

11 Claims, 19 Drawing Sheets

BLIND FRAME FOR A WINDOW OR A DOOR

FIELD OF THE INVENTION

The present invention relates to frames for windows and doors, in general and, in particular, to blind frames for aluminum windows and doors.

BACKGROUND OF THE INVENTION

Building with aluminum door and window frames had been common for many years. Traditionally, the masons build a wall of cement blocks, with cement pillars and beams, leaving openings to receive the windows and doors. These openings are of approximately the size and in approximately the location of the doors and windows in the architect's plans, although precision is difficult if not impossible.

The aluminum specialist then measures the openings in the walls, and makes a custom blind frame of the correct dimensions for each opening. The blind frame is hidden in wall, and an outer frame holding a window sash or door panel is mounted thereon. The blind frame is disposed in the opening and affixed in place by means of bolts extending through the frame and into the cement defining the opening. It will be appreciated that this structure is not particularly stable, and cracks often appear in the plaster around the door and window frames, over time.

The window or door outer frame is then mounted on the blind frame and sealed in place with silicone to provide the desired seal to prevent moisture and wetness. Similarly, the jambs holding the door or window pane are mounted on the outer frame and sealed with silicone. It will be appreciated by those skilled in the art that the use of silicone is expensive and does not provide a flexible seal over time. Rather, inexpert work in inserting the silicone in place can cause water leakage. On the other hand, removing dried silicone is extremely inconvenient.

This building method is very labor intensive, as each window must be custom made for its frame, which is manufactured for it, and cannot be mounted in another opening. Furthermore, the frames are not sturdily mounted in the walls, leading to cracking of plaster around the frames, and often to loosening of the frame, which can result in the reduction of insulation of the room or building.

Accordingly, there is a long felt need for, and it would be very desirable to have a blind frame which is stable once in place, and it would be desirable to have such a frame which is substantially modular or of standard sizes.

The building methods described above relate to conventional building methods. However, it will be appreciated that many buildings are now prefabricated and assembled by industrial methods, such as using pre-cast elements which can be rapidly mounted on site. In such buildings, a portion of a wall is formed, a mold is built on the outside surface, an outer frame for each window is mounted in the wall, a mold is built on the inside surface, and concrete is cast into the mold. When the window has decorative elements, for example on the wall around an interior or exterior frame, these elements must be added later with the plaster, exterior cladding and other finish.

SUMMARY OF THE INVENTION

There is provided according to the present invention an outer frame for a window or door, the frame having a channel defining a space between the frame and an adjacent wall, said space being adapted and configured to receive an amount of cement or concrete so as to affix the frame in its location to the wall.

According to a preferred embodiment, the space extends substantially around the periphery of the frame.

According to one embodiment of the invention, the frame further comprises two pairs of frame segments of a preselected standard size.

According to one embodiment of the invention, the frame is formed of galvanized sheet metal.

According to a preferred embodiment of the invention, a portion of the channel includes a plurality of filling apertures opening into the space for casting concrete therethrough.

Further according to one embodiment, the space is defined partially by an integral shoulder, which acts as a stopper for a window or door mounted in the frame to abut against.

According to another embodiment of the invention, the frame further includes a top segment defining an accessory compartment configured and adapted for storing a window accessory, the accessory compartment including an external surface adapted and configured to support an amount of concrete and be embedded therein. The top portion may be curved and convex, or may have any desired geometric shape.

There is also provided according to the present invention a method for mounting a blind frame in a wall, the method including building a partial wall, disposing a blind frame on the partial wall, the blind frame having a space extending substantially around the periphery of the frame, building the wall around the sides of the frame, and casing concrete into the space between the frame and the wall.

There is further provided according to the invention an accessory compartment configured and adapted for storing a window accessory, the accessory compartment including a housing, said housing having an external surface adapted and configured to support an amount of concrete and be embedded therein. The external surface of the housing may be curved and convex, or may have any desired geometric shape.

There is also provided a method for mounting in a wall an accessory compartment configured and adapted for storing a window accessory, the method including providing a wall having a window aperture, providing a mold in the aperture, providing an accessory compartment having a housing, the housing having an external surface adapted and configured to support an amount of concrete and be embedded therein, seating the housing in the mold, and casting concrete in the mold around the housing so as to embed the housing in the concrete in the wall.

BRIEF DESCRIPTION OF THE DRAWINGS

The present invention will be further understood and appreciated from the following detailed description taken in conjunction with the drawings in which.

DETAILED DESCRIPTION OF THE INVENTION

Figure 1:
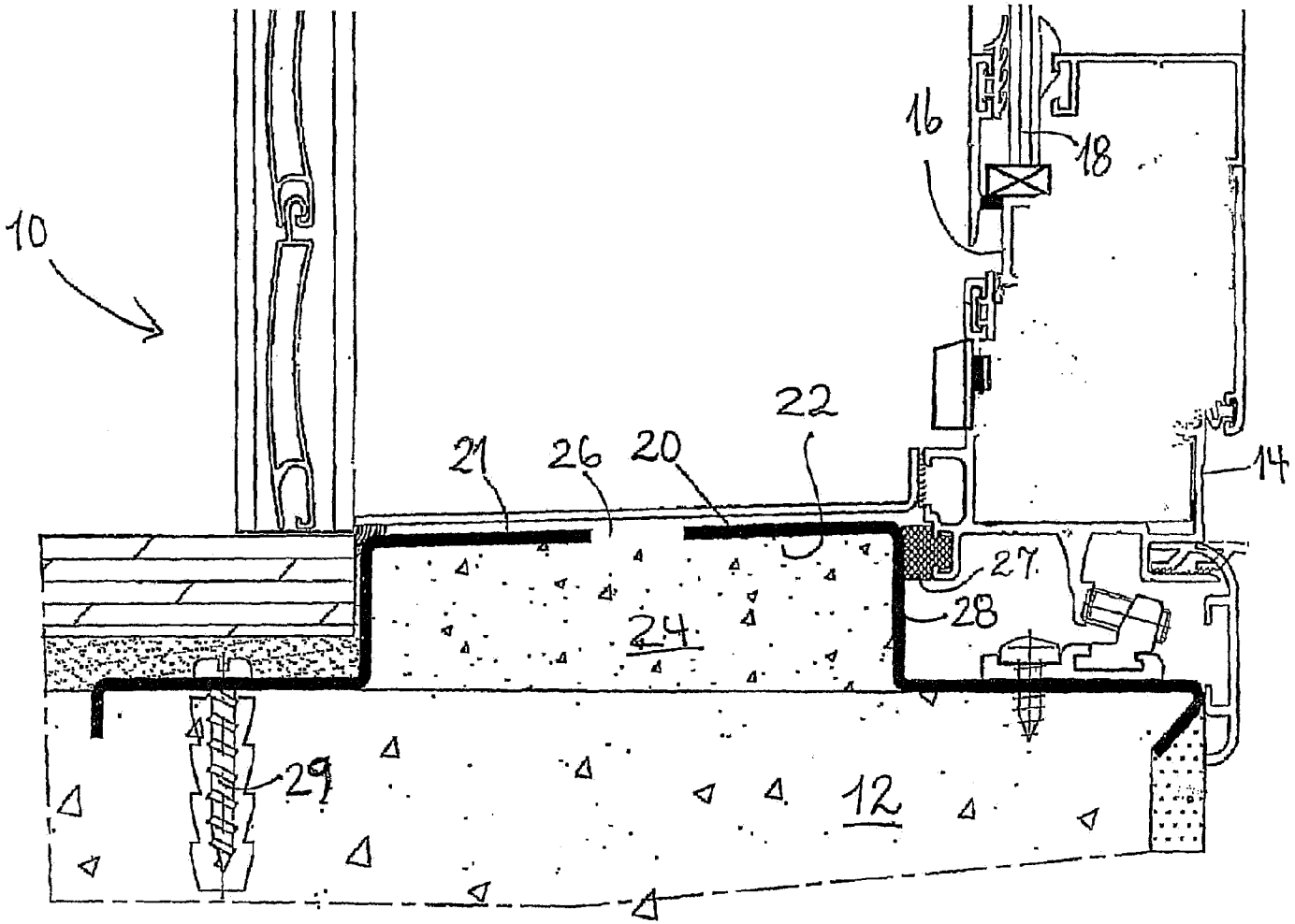
FIG. 1 is a sectional illustration of a window having a blind frame constructed and operative in accordance with an exemplary embodiment of the present invention.

The present invention relates to blind frames for windows and doors, particularly of aluminum, which can be manufactured and sold in pre-selected standard sizes, which can be affixed to a wall so that the windows and doors are more stable than conventional windows, and which are configured to be incorporated into a conventional or prefabricated wall during construction of the wall. This is accomplished by providing a blind frame having a peripheral channel defining a space, between the frame and the wall, which is adapted and configured to receive an amount of concrete or cement, so as to affix in a stable manner the frame in its location in a surrounding wall. Referring now to FIG. 1, there is shown a sectional illustration of the bottom of a window 10. Window 10 has a blind frame 20, of which the bottom portion is shown in FIG. 1, constructed and operative in accordance with an exemplary embodiment of the present invention. Blind frame 20 is mounted in a wall 12. A window frame 14 is coupled to blind frame 20 and holds a profile 16 in which is mounted a window pane or door panel 18.

Blind frame 20 defines a peripheral channel 21 defining a space 22 between the frame and the wall 12 in which the frame is mounted. Space 22 is adapted and configured to receive an amount of cast concrete 24 so as to affix the frame in its location in wall 12. A plurality of filling apertures 26 may be provided in channel 21 in the bottom portion of the frame, through which concrete or cement can be poured into space 22, in case it is not completely filled during casting. Blind frame 20 is generally formed of two pairs of frame segments, possibly of a pre-selected standard size, as explained in detail hereinbelow, welded or clamped to one another to form a substantially rectangular frame. Alternatively, the frame may be of any shape and size as designed by the architect. The embodiment illustrated in FIG. 1 shows the sill portion of the blind frame 20. Preferably, the channel 21 extends substantially around the periphery of the frame, whereby the blind frame, and thus, the entire window or door, can be firmly anchored in the wall on all sides.

A portion of the channel preferably defines a stop member configured to engage sealing means on the outer frame of a window or door, when the outer frame is mounted on the blind frame.

According to one embodiment of the invention, the frame is formed of galvanized sheet metal. Alternatively, the frame may be formed of any suitable strong material.

Preferably, a portion of the channel 21 defines a stop member 28 configured to engage sealing means 27 on the outer frame 14 of a window or door, when the outer frame is mounted on the blind frame. It will be appreciated that provision of such a stop member permits the use of rubber seals between the outer window frame and the blind frame, which provide a substantially hermetic seal against gases, rather than using conventional silicone seals. In the embodiment of FIG. 1, channel 21 is substantially rectangular in cross-section. However, there is no need for channel 21 to be symmetrical, and channel 21 may have any desired shape, as long as it can hold cast concrete for adhering the frame to the wall.

The method of mounting the frame in a wall of cement blocks is as follows. The sizes of the various windows, as designed by the architect, are sent to the factory. Blind frames are constructed, and sent to the building site. The wall is built by the mason up to the level of the bottom of the window frame as designed by the architect. Preferably, the wall is leveled so as to be substantially horizontal. The blind frame is now placed on the wall, and may be held in place, as by bolts 29.

Once the blind frame is in place, the mason continues to build the wall around the sides of the frame, until he reaches the top of the frame. A mold is built around the frame and a horizontal beam is then cast above the frame and the adjacent walls, filling the spaces 22 on the top, sides and bottom of the frame with concrete, so that the frame will remain affixed to the wall in a very stable manner. If necessary, additional concrete can be poured into space 22 beneath the frame through filling apertures 26 in channel 21 in the bottom portion of the frame, in order to ensure that space 22 is completely filled. According to one preferred embodiment of the invention, frame 20 is manufactured from a profile cut into several pre-selected standard sizes. This is possible due to the above-described method of mounting the frame in the wall. In this method, the architect will design the windows utilizing the pre-selected standard sizes, and the windows and their associated frames can be formed in the factory using the standard size elements. It will be appreciated that this provides a substantial savings in both manufacturing and mounting of windows and doors. Two pairs of same size frame segments may be welded together to form the frame, or the segments may be coupled to one another by clamps, to permit last minute adjustment on site.

Figure 2:
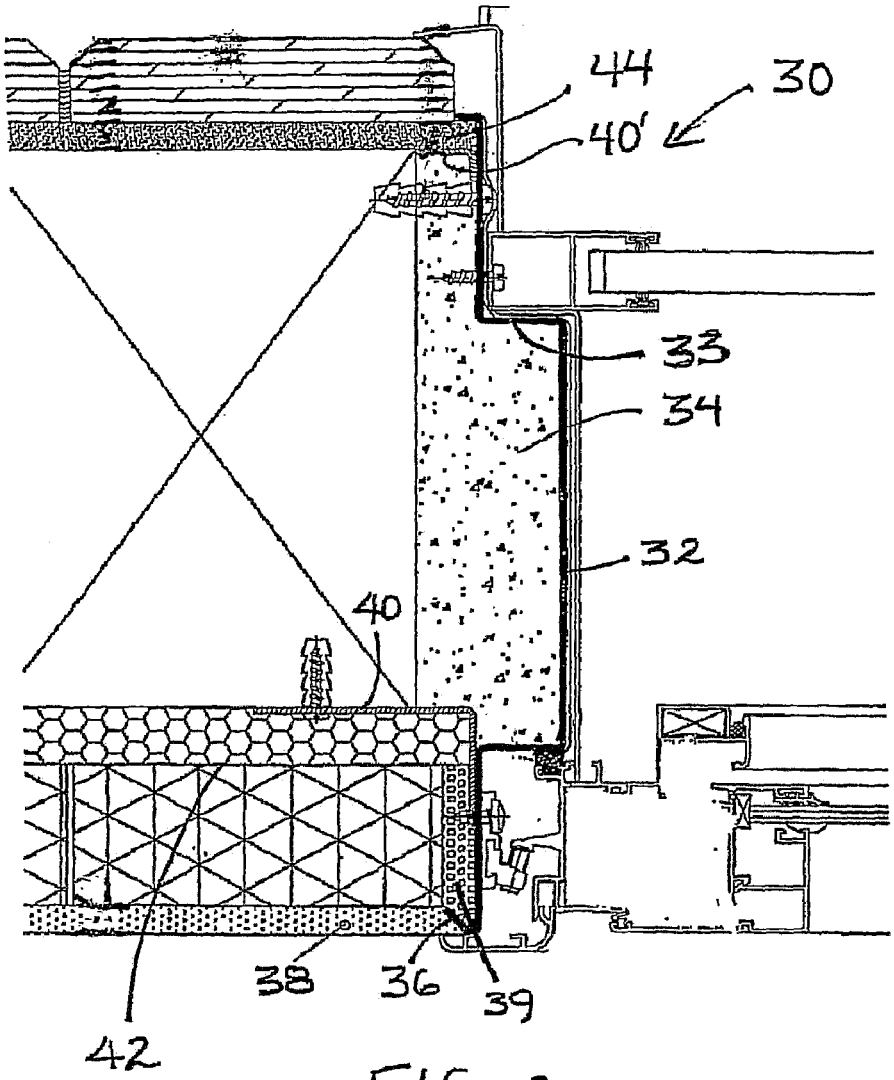
FIG. 2 is a sectional illustration of a second window having a blind frame constructed and operative in accordance with the embodiment of the present invention.

FIG. 2 is a top sectional illustration of a second window 30 constructed and operative in accordance with another embodiment of the present invention having a blind frame 32.

Blind frame 32 is substantially similar to blind frame 20 and has a peripheral channel 33 defining a space 34 which can be filled with concrete. Frame 30 may include an angled edge 36 which may serve as a straight base for applying plaster 38 to the inside surface of the wall. Additionally, angled edge 36 may be utilized to hold polyurethane foam 39. Additional metal elements 40, 40' may be mounted on frame 32, for example, for holding insulation 42 or a base plate 44, for example, for holding stone or marble cladding.

Figure 3A:
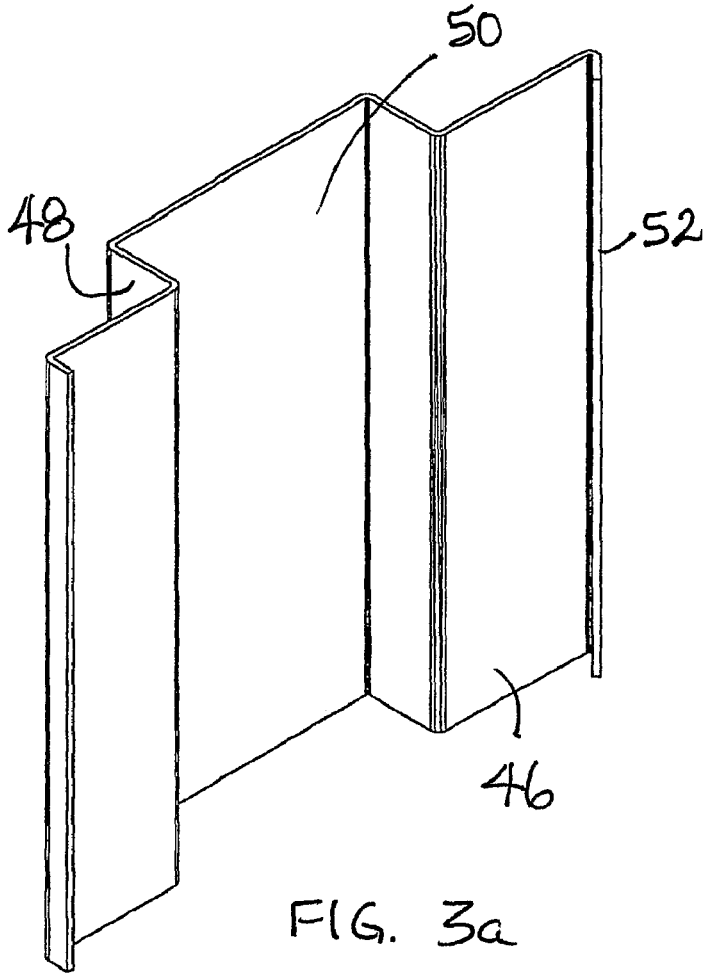
FIGS. 3*a* and 3*b* are perspective and sectional illustrations, respectively, of a profile for a blind frame constructed and operative in accordance with one embodiment of the present invention.
Figure 3B:
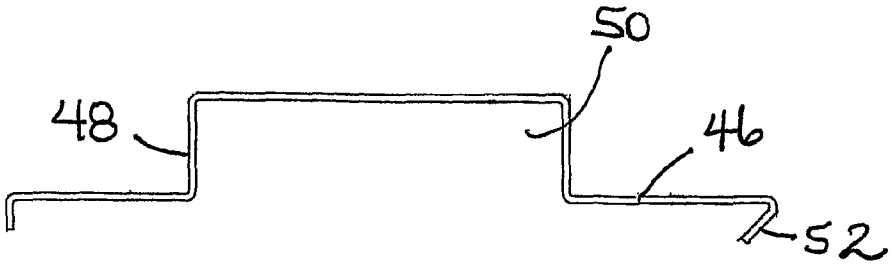

FIGS. 3*a* and 3*b* are perspective and sectional illustrations, respectively, of a profile 46 for forming a blind frame in accordance with one embodiment of the present invention. Profile 46 can be cut to any desired length for forming the blind frame. Profile 46 includes a shoulder 48 defining one side of a symmetrical channel 50. Alternatively, channel 50 may be asymmetrical. Profile 46 is shown with an angled edge 52, such as that described above with respect to FIG. 2.

Figure 4:
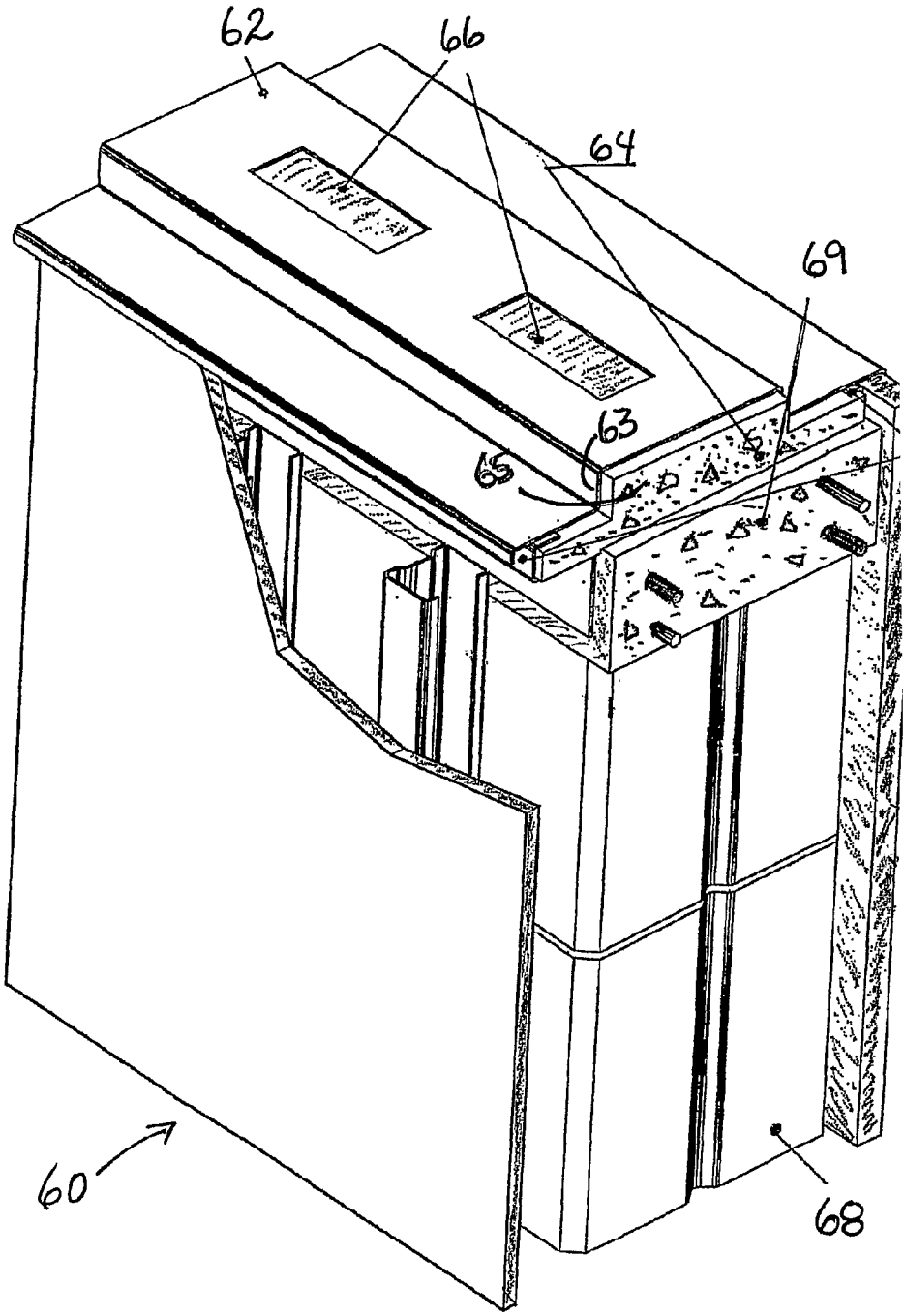
FIG. 4 is a schematic illustration of a portion of a wall holding a blind frame of FIG. 3*a;*

FIG. 4 is a schematic illustration of a portion of a wall 60 supporting a window sill and holding a blind frame 62 according to an alternative embodiment of the invention, without an angled edge. Frame 62 has a peripheral channel 63 defining a space 64. Filling apertures 66 may be provided which open into space 64 for additionally filling the space with concrete 65. As described above, wall 60 is shown built of cement blocks 68 or concrete to the height of the window and a beam 69 is cast thereon. Frame 62 is placed on beam 69, the wall is built on the sides of the frame, and concrete is cast around the window.

Figure 5:
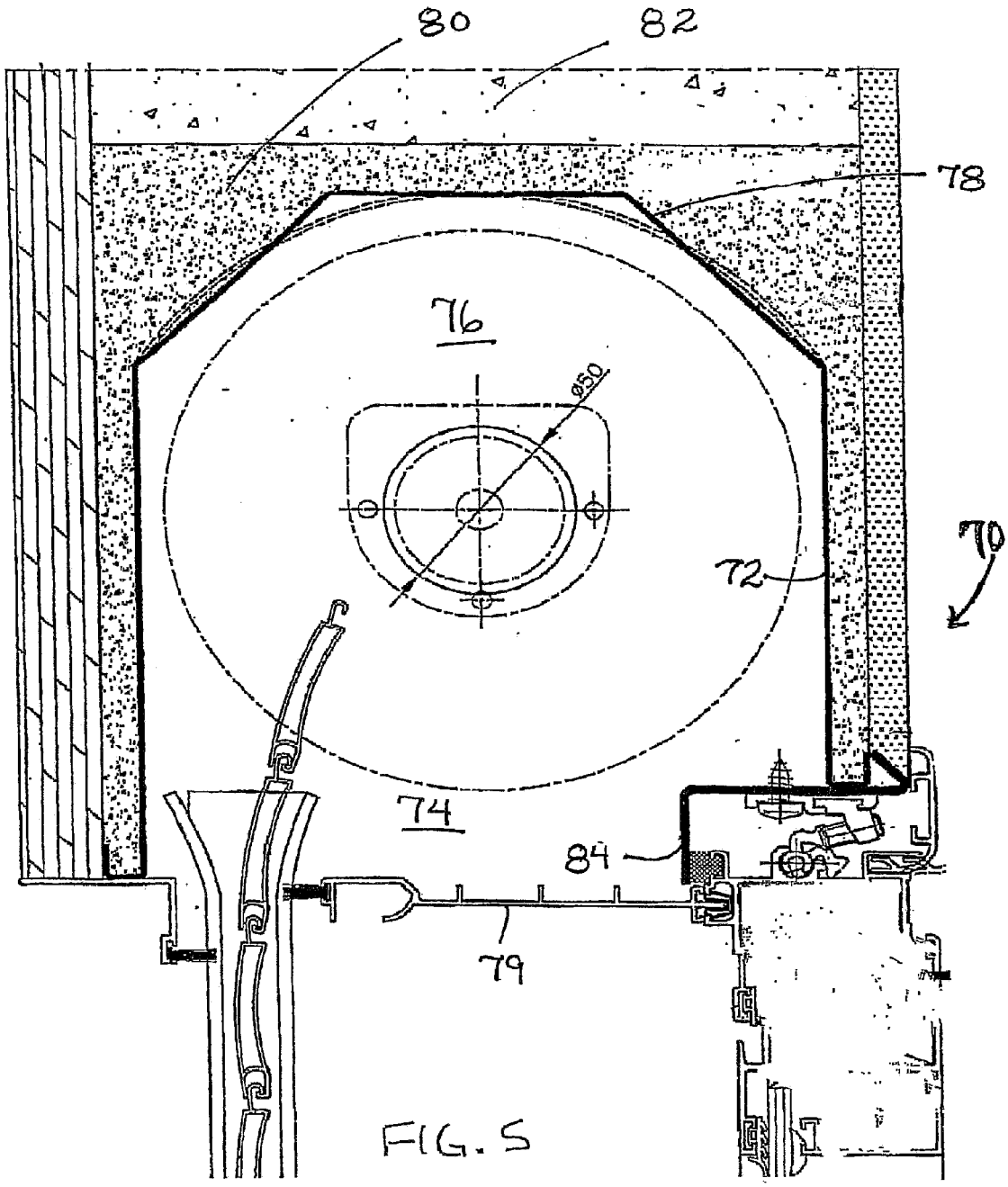
FIG. 5 is a sectional illustration of a window having a blind frame constructed and operative in accordance with an alternative embodiment of the present invention having a space for storing a window accessory.

FIG. 5 is a sectional illustration of a window or door 70 having a blind frame constructed and operative in accordance with an alternative embodiment of the present invention. In this embodiment, the top segment 72 of the frame is not identical to that on the sides, but rather defines an accessory compartment 74 for storing a window accessory 76, here illustrated as a roller blind. Top segment 72 is preferably formed of steel or of galvanized sheet metal. The top segment 72 also includes an external surface 78 adapted and configured to support an amount of concrete 80 so as to anchor or embed the top segment in the wall. This layer of concrete can replace the conventional beam which is cast above the window frame in conventional buildings, and concrete blocks 82 may be placed on top of it to continue the wall. The top segment may be curved and convex, or may have any desired geometric shape. Here, top segment 72 is illustrated as being pentagonal in shape. Alternatively, it can be hexagonal, octagonal, round, or of any other desired shape which provides an internal space for storing a window accessory. Preferably, top segment 72 also includes a supporting profile 84 to which the top profile of the finished window is coupled. It is a particular feature of the frame of this embodiment having an integral top segment, that it may provide an hermetic seal preventing passage of gases or moisture from outside the window into the interior of the building. This also serves to improve the temperature insulation provided by the window or door.

It is a particular feature of this embodiment of the invention that the access to the window accessory 76 is through the bottom of top segment 72, rather than through an unsightly opening in the wall, itself, as occurs in conventional so-called "mono-block" frames, and the accessory can be reached in situ, without having to remove the window frame from the wall. Thus, a removable closure profile 79 may be provided, as between the window frame and the track for a roller blind, which can be opened when standing inside the window and which permits removal, repair and replacement of the window accessory through the bottom of top segment 72.

Figure 6A:
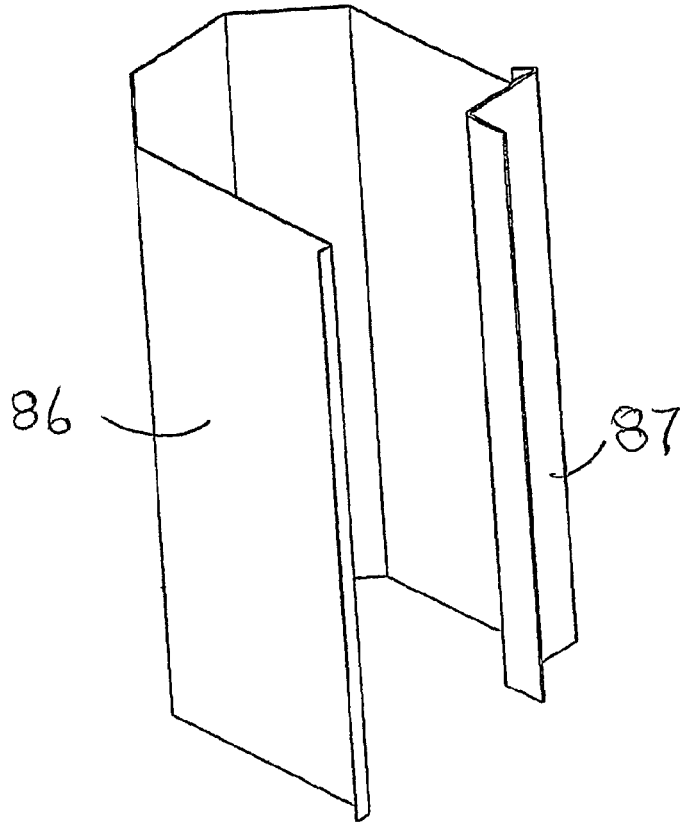
FIGS. 6*a* and 6*b* are perspective and sectional illustrations, respectively, of a profile for an accessory compartment of a blind frame constructed and operative in accordance with one embodiment of the present invention.
Figure 6B:
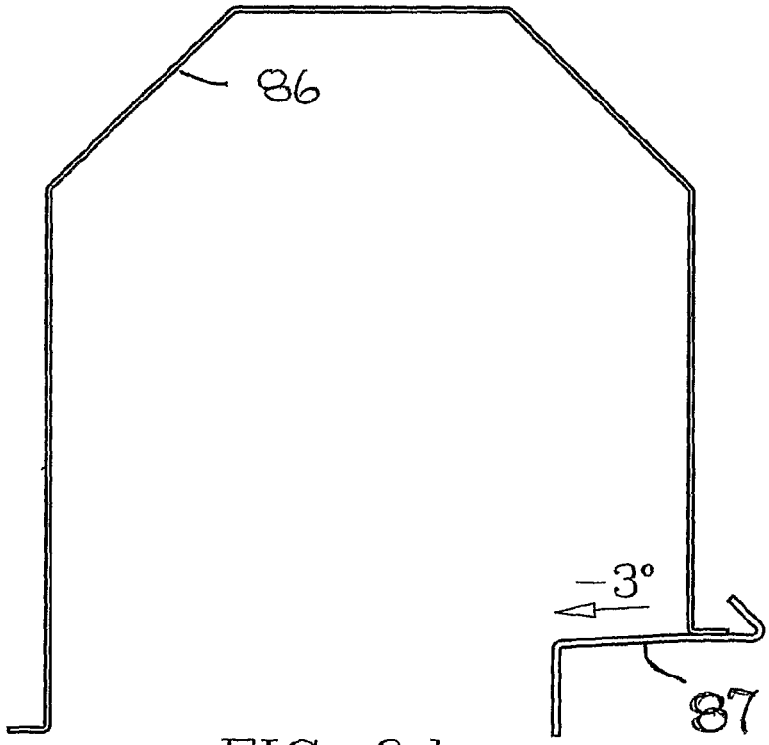
Figure 6C:
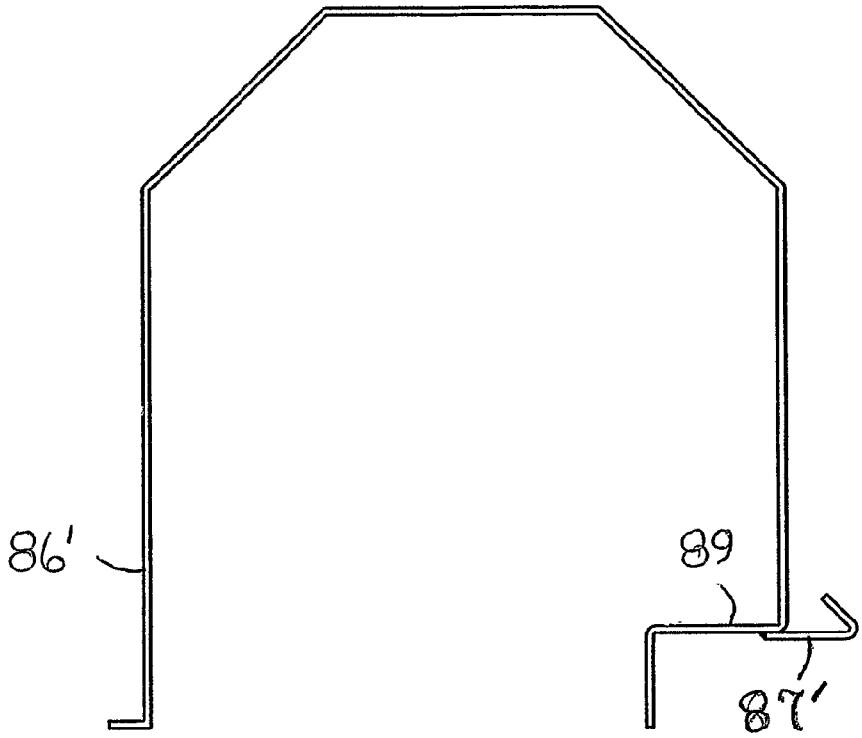
FIG. 6*c* is a sectional illustration of a profile for an accessory compartment of a blind frame constructed and operative in accordance with another embodiment of the present invention.

One exemplary embodiment of a top segment or accessory compartment 86 is shown in perspective and sectional views in FIGS. 6*a* and 6*b*, respectively. As can be seen, supporting profile 87 is welded to top segment 86. Preferably, supporting profile 87 is affixed to top segment 86 at a slight angle, e.g., 3°, to prevent moisture from entering the window through the joint. According to an alternative embodiment, shown in FIG. 6*c*, top segment 86' is formed with an integral, inwardly extending shoulder 89 which serves to prevent leakage of gases and moisture from the exterior to the interior. Supporting profile 87' may be welded to the outside surface of flange 89.

Figure 7A:
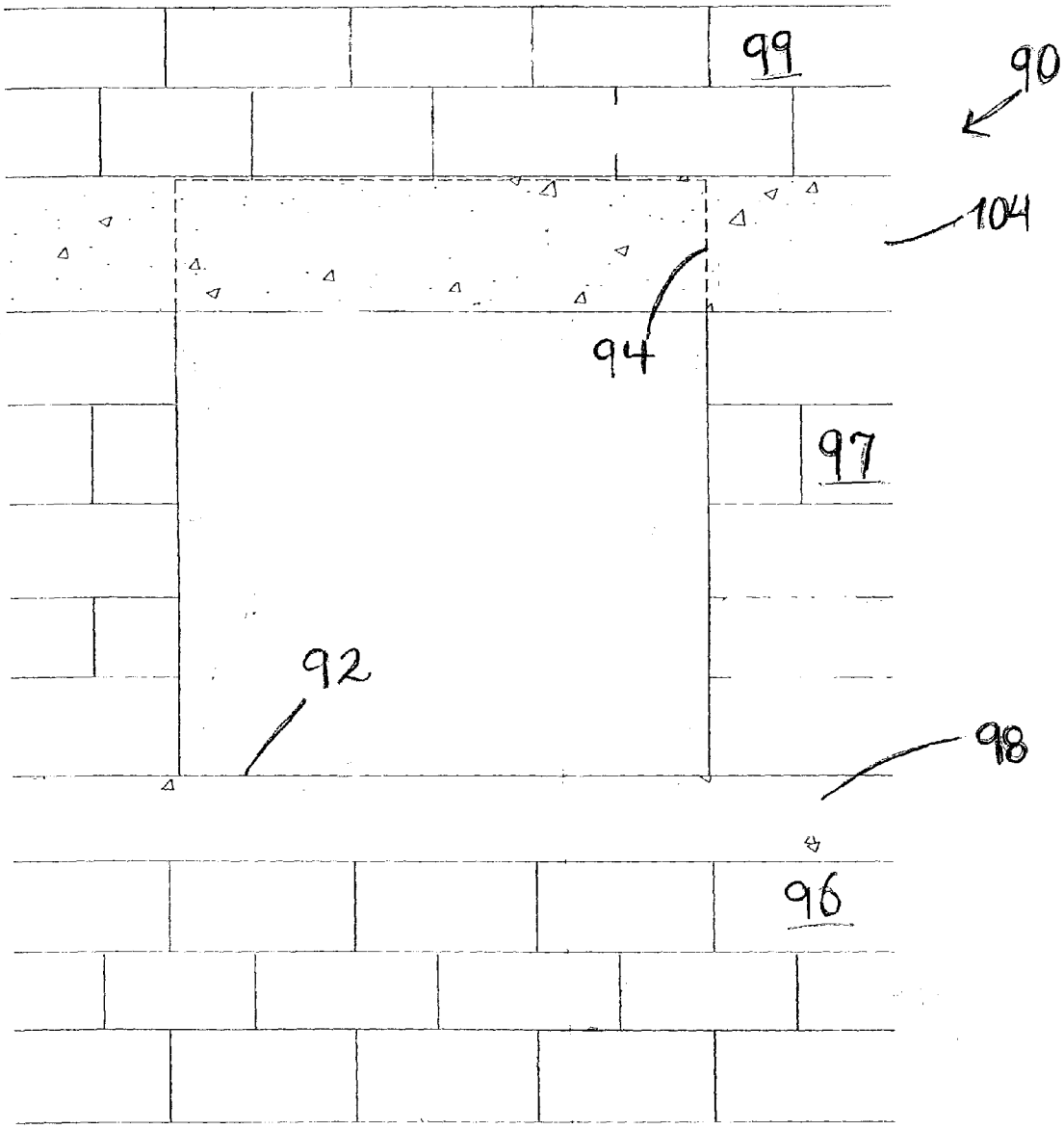
FIGS. 7*a*, 7*b* and 7*c* are schematic plan, sectional and perspective illustrations of a portion of a wall holding a blind frame of FIG. 6*a;*
Figure 7B:
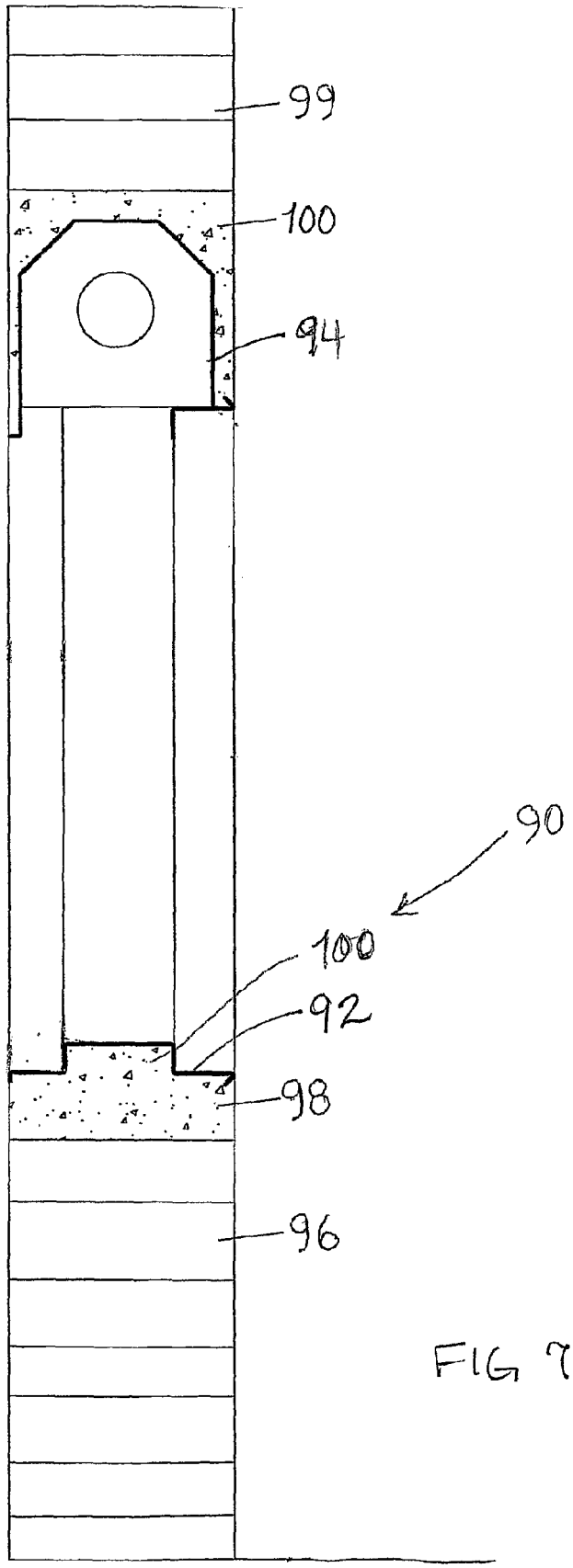
Figure 7C:
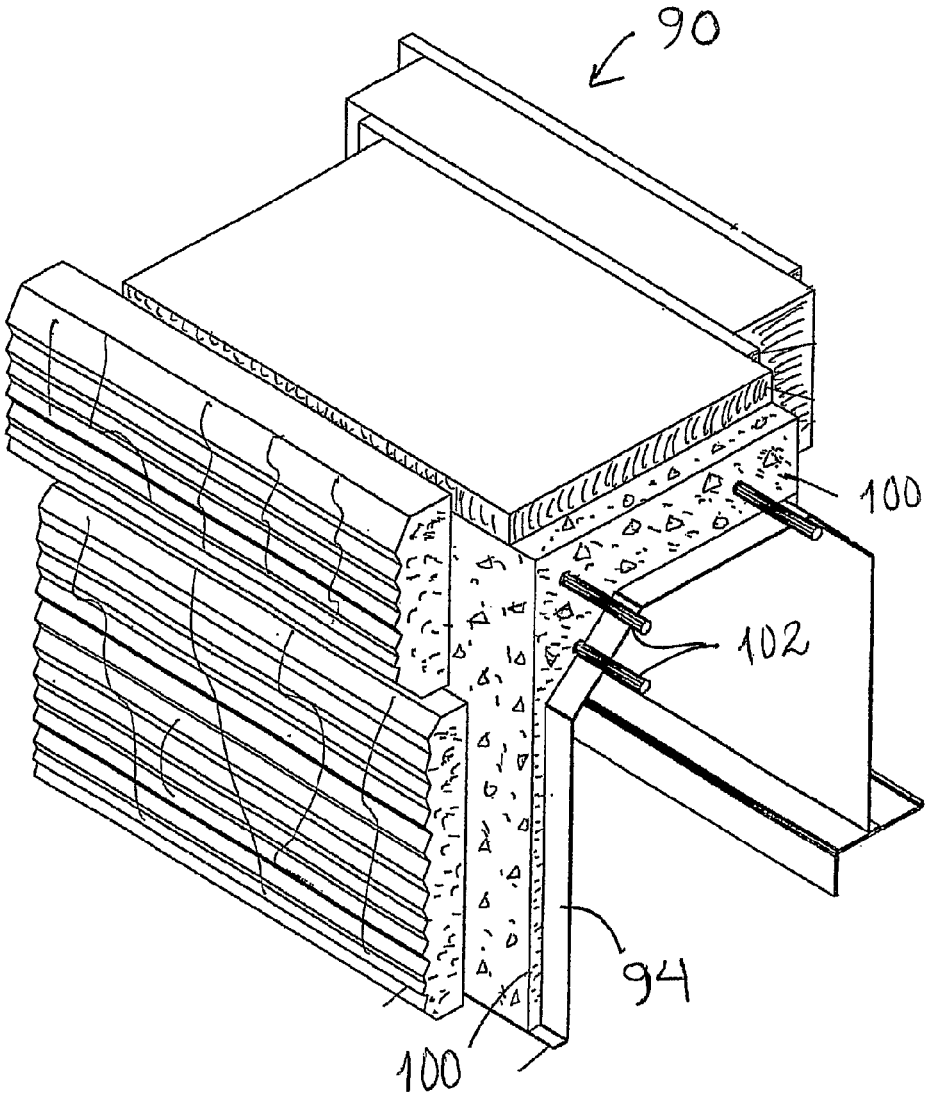

This embodiment may be mounted as follows, with reference to FIGS. 7*a*, 7*b* and 7*c*, schematic plan, sectional and perspective illustrations of a portion of a wall 90 holding a blind frame 92 having a top segment 94. The sizes of the various windows planned by the architect and having roller blinds, or other window accessories, are sent to the factory. Blind frames are constructed including a top segment defining an accessory compartment for storing the window accessory, and sent to the building site. The wall is built by the mason up to the level of the bottom of the window frame, indicated as blocks 96. A horizontal beam 98 is cast on the blocks and the wall is leveled so as to be substantially horizontal. The blind frame 92 is now placed on the wall and, if desired, may be held in place, as by bolts (not shown).

Now the mason continues to build the wall, e.g., concrete blocks 97, on top of beam 98 around the sides of the frame 92, until he reaches the top of the top segment 94. Concrete 100 can now be poured from the top segment 94 over the entire blind frame 92, filling the spaces in the sides and bottom of the frame, and the frame will remain affixed to or embedded in the wall in a very stable manner. Reinforcing rods 102 may be provided, as desired.

According to an alternative building method, the walls may be built on the lower beam 98 around the sides of an opening for receiving the frame, and only then is the pre-fabricated frame placed in the opening. Then, as above, concrete is poured around the entire frame, anchoring it in place in the wall. It will be appreciated that the concrete may be cast together with an upper beam 104 along the top of the window. In this way, the top segment 94 of the frame will be firmly embedded in the concrete. Additional blocks 99 may be added above the upper beam 104, until the level of the ceiling is reached.

According to one preferred embodiment of the invention, top segment 94 is manufactured from a profile cut into several pre-selected standard sizes. This provides a substantial savings in both manufacturing and mounting of holders for storing accessories for windows and doors.

Figure 8A:
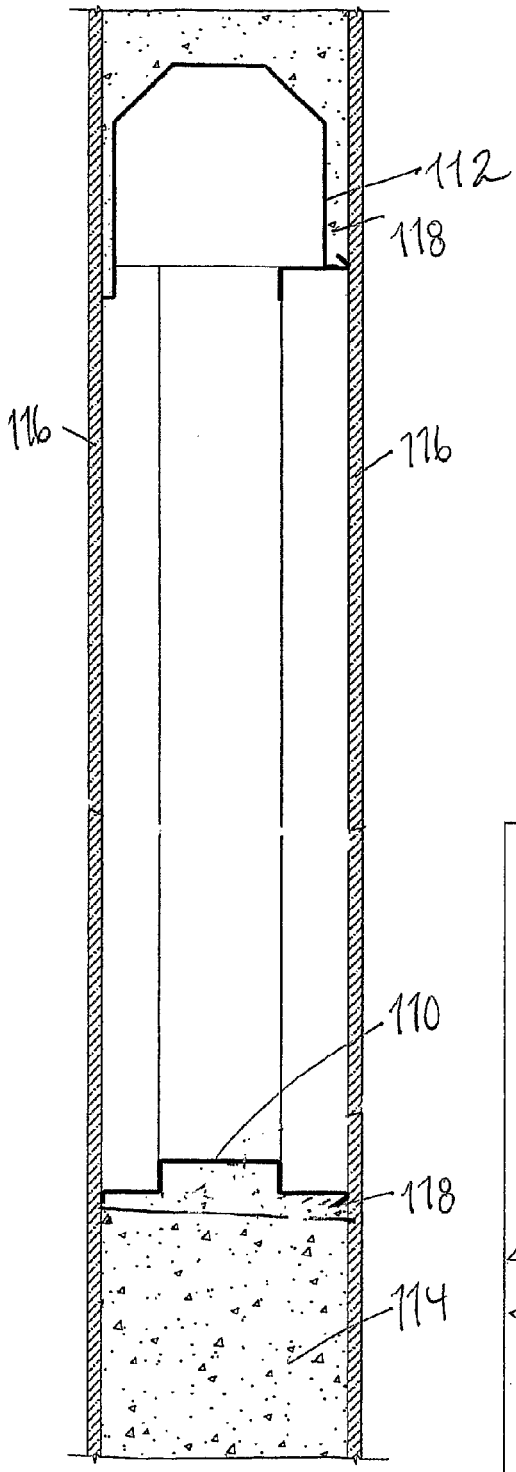
FIG. 8*a* is a side sectional view of a pre-cast wall with a blind frame according one embodiment of the present invention.
Figure 8B:
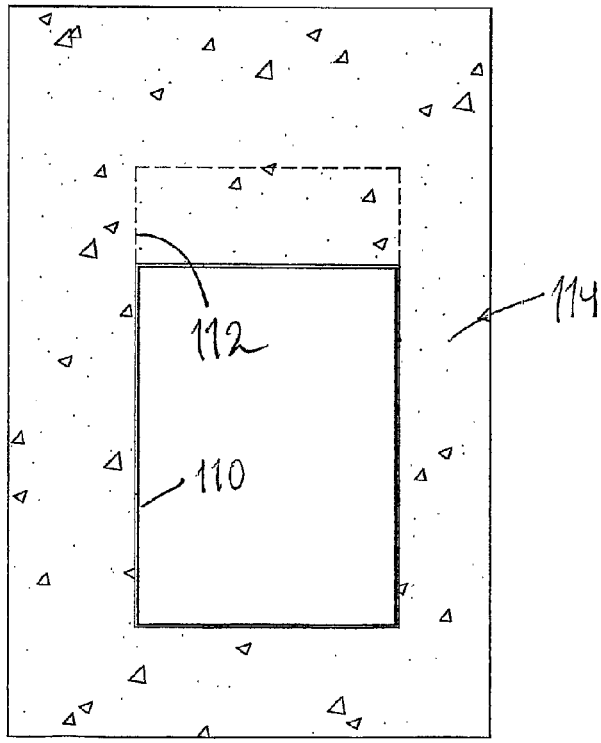
FIG. 8*b* is a plan view of a section of the wall of FIG. 8*a;*

The building methods described above, with reference to Figures 1*a* to 7*c*, relate to conventional building methods. When utilizing the frames of the present invention in industrialized building, such as using prefabricated elements, the conventional industrial method can be used when the window is no wider than the wall. See, for example, FIG. 8*a*, a side sectional view of a blind frame 110 having a top segment 112 according the present invention, in a pre-cast wall. The wall 114 is constructed, as known, to the level of the window, and a mold 116 of steel or wood is built along the exterior surface of the wall. Frame 110 is placed therein. A mold 116 of steel or wood is built along the interior surface of the wall, and concrete 118 is poured into the mold around frame 110. A plan view of the wall 114 after casting is shown in FIG. 8*b*.

Figure 9:
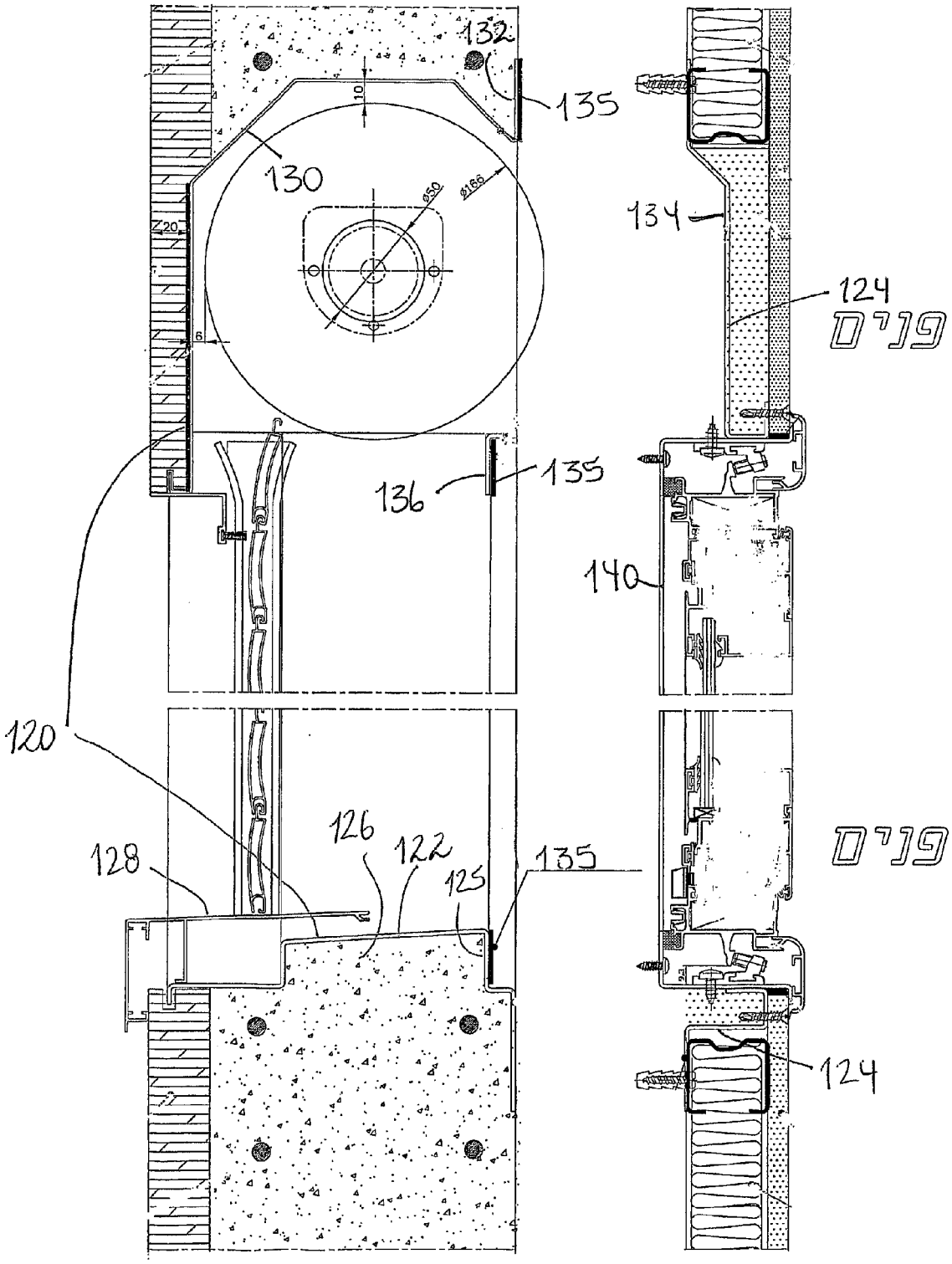
FIG. 9 is an exploded sectional view of a window having a blind frame constructed and operative in accordance with another embodiment of the invention.

However, when the window of the invention is wider than the wall, or has decorative elements, for example on the wall around an interior or exterior frame, this method is problematic. According to the present invention, there is further provided a blind frame for a window which is suited for prefabricated buildings, one exemplary embodiment of which is illustrated in FIG. 9, an exploded sectional illustration of a window having a blind frame 120 constructed and operative in accordance with another embodiment of the invention. This frame 120 is divided into two portions, a first portion 122 for being mounted or embedded in the prefabricated wall, and a complementary second portion 124 adapted to be affixed to the first portion 122 once it has been mounted in the wall. It will be appreciated that the frame 120, once the two portions are affixed, is substantially identical to the unitary frame described above.

As can be seen in FIG. 9, the first portion 122 of blind frame 120 includes a channel 125 having a shoulder. The channel defines a space 126, preferably extending along the circumference of both sides and the bottom of the frame, which can be filled with concrete. A track supporting profile 128 may be added to the outside of the first portion after the concrete is cast.

As can be seen, space 126 is not symmetrical. Rather, the shoulder portion of channel 125 which faces the interior of the building is adapted and constructed to be sufficiently large to provide a firm anchorage for the complementary interior portion 124. Similarly, the top segment 130 of the mounting portion is cut off and includes an upwardly extending extension 132. Extension 132 both serves as a mold portion for holding the concrete on top of the top segment, and as an affixing surface for affixing the interior portion to the mounting portion of the frame. The interior closure portion 134 of the profile forms part of the complementary interior portion 124 of the frame.

Double-sided tar or other sealing adhesive 135 may be applied to the inward facing surfaces of shoulder 125, extension 132 and to a supporting profile 136, for engaging the outward facing surfaces of the complementary portions of interior portion 124 of the frame. As can be seen, complementary interior portion 124 of the frame includes a portion 140 welded or otherwise affixed to top segment 134 and a bottom segment 139 for holding the window or door. Profile 140 also may be adapted and configured to be affixed to portions of the blind frame in registration therewith.

Figure 10:
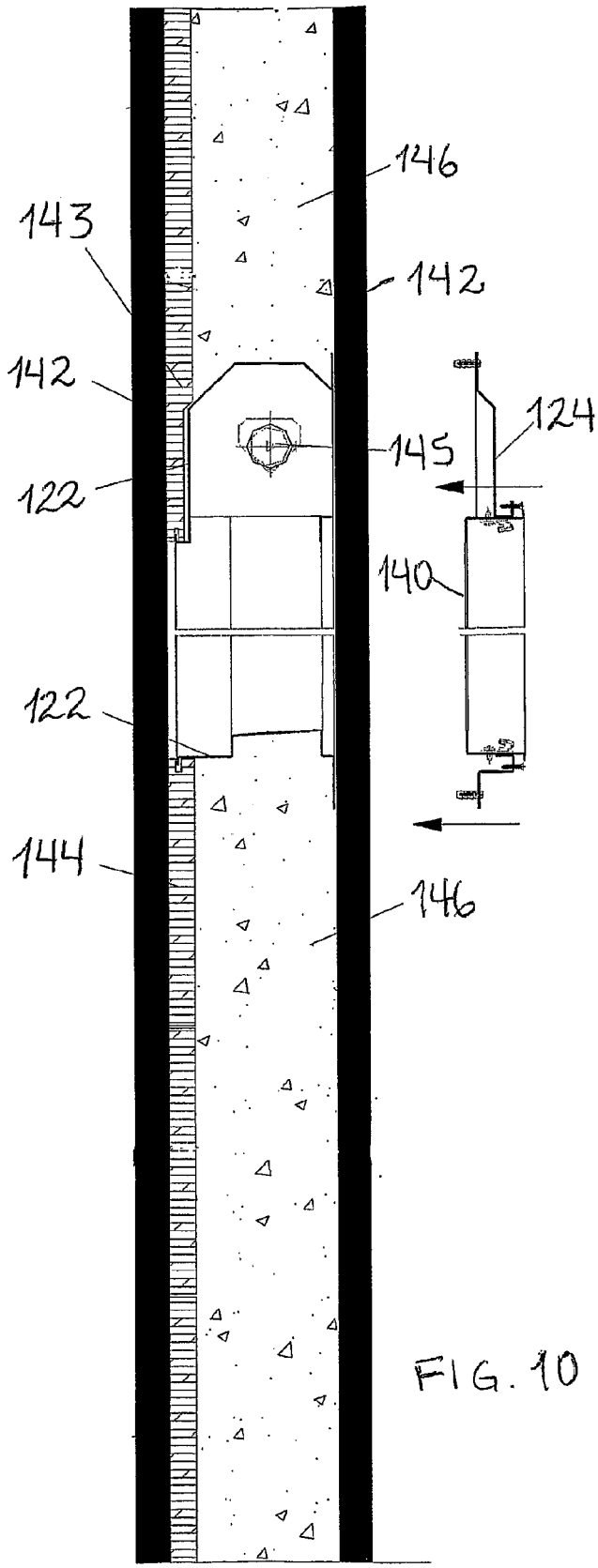
FIG. 10 is a schematic illustration of a method of building using the window of FIG. 9.

FIG. 10 is a schematic illustration of a method of building using the window of FIG. 9. As in conventional industrialized building, wall segments are prepared to the level of the window. A mold 142 is assembled on the exterior surface of the building. Lower cladding 144 is mounted in mold 142 to the level of the window frame. The mounting portion 122 of blind frame 120 is mounted in the wall, and cladding 143 is continued from the frame upwards to a desired height (i.e., the ceiling). Electric cables 145, etc. may now be provided inside the wall. A mold 142 is now assembled on the interior surface of the wall, and concrete 146 is poured into the mold, covering and embedding the mounting portion 122 in the wall. Once the molds 142 are removed, the complementary interior portion 124 is sealingly affixed to the mounting portion 122, and interior and exterior finish is applied.

Figure 11:
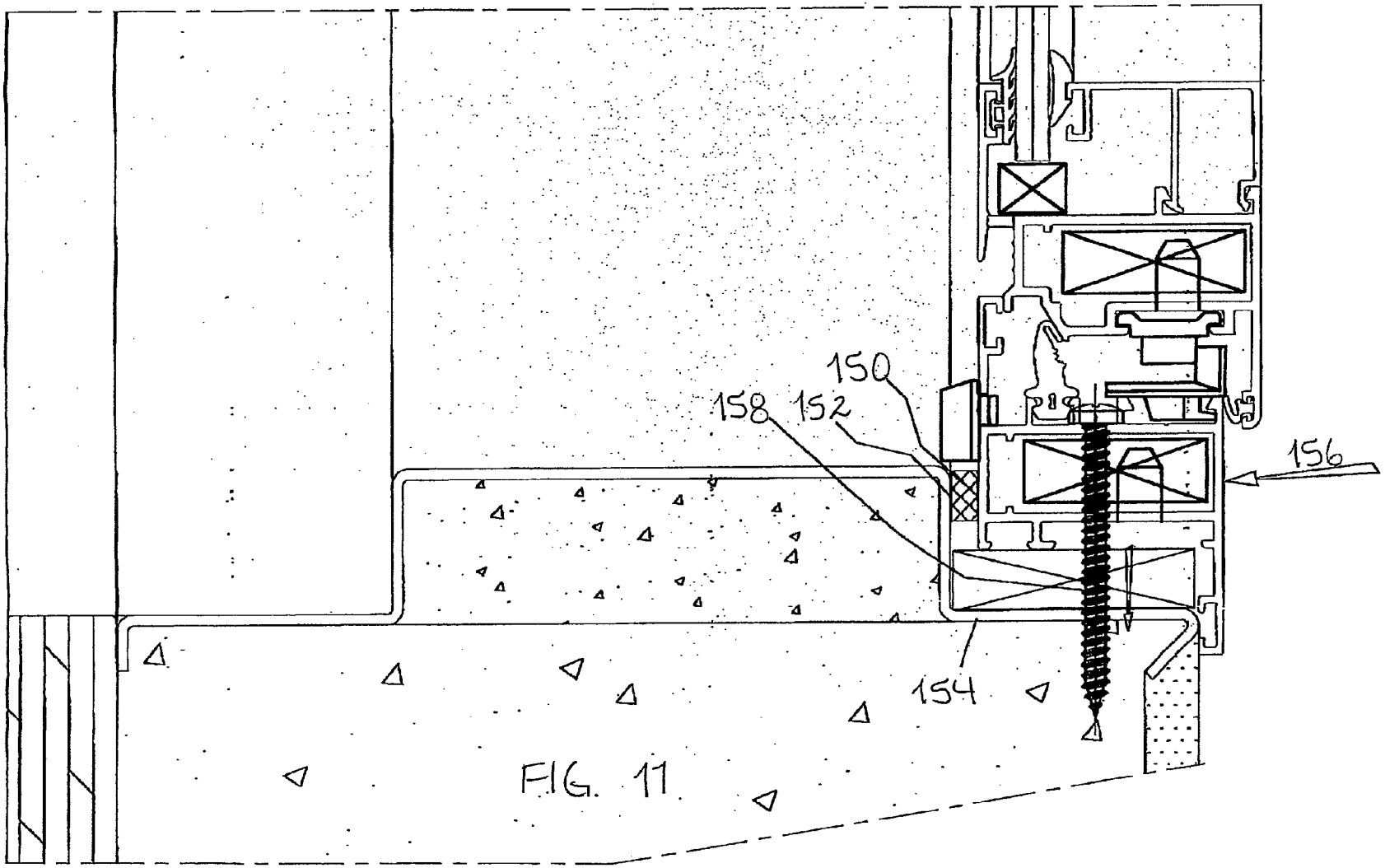
FIG. 11 is a sectional illustration of a window having a blind frame constructed and operative in accordance with an alternative embodiment of the present invention.

According to one embodiment of the invention, illustrated in FIG. 11, a strip of sealing material 150, preferably foam rubber, is affixed to the stop member 152 defined by a portion of the blind frame 154, instead of being mounted on the outer frame of a window or door. In this way, conventional outer window frames 156, which have no such sealing material in the required location, can be mounted on the blind frame of the present invention and fixed in place, as by bolts 158. In this way, rubber seals, which provide a substantially hermetic seal against gases, rather than conventional silicon seals, can be utilized between the outer window frame and the blind frame. In the embodiment of FIG. 11, sealing material 150 is affixed to stop member 152 by an adhesive strip or glue.

Figure 12:
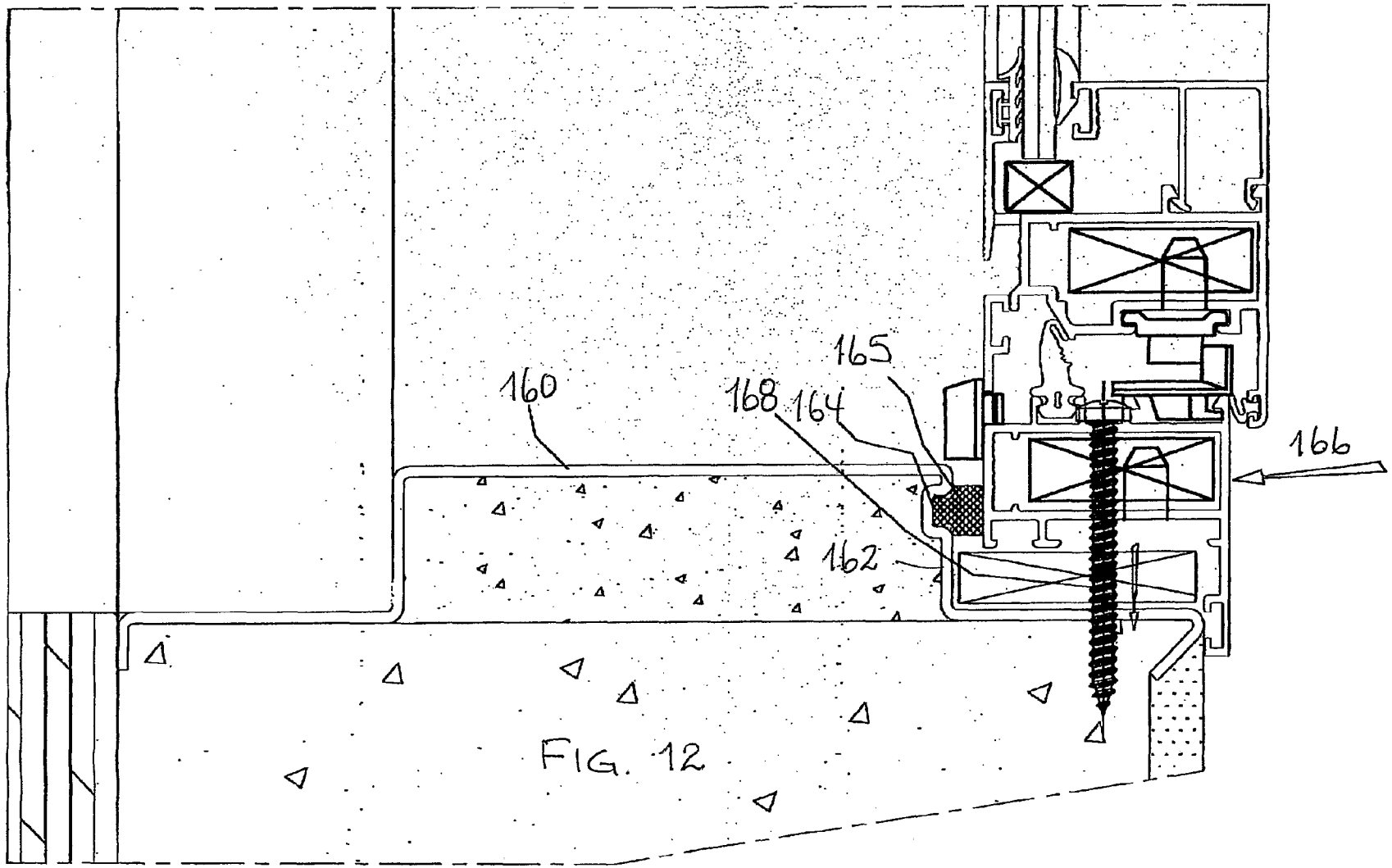
FIG. 12 is a sectional illustration of a window having a blind frame constructed and operative in accordance with another embodiment of the present invention.

Alternatively, as shown in FIG. 12, the stop member 162 of blind frame 160 may define a seal receiving track 164. A sealing material 165, preferably rubber, is affixed in seal receiving track 164, as by means of super glue or other fast acting adhesive. Here, too, a conventional window frame 166 can be affixed, as by a bolt 168, to blind frame 160.

Figure 13:
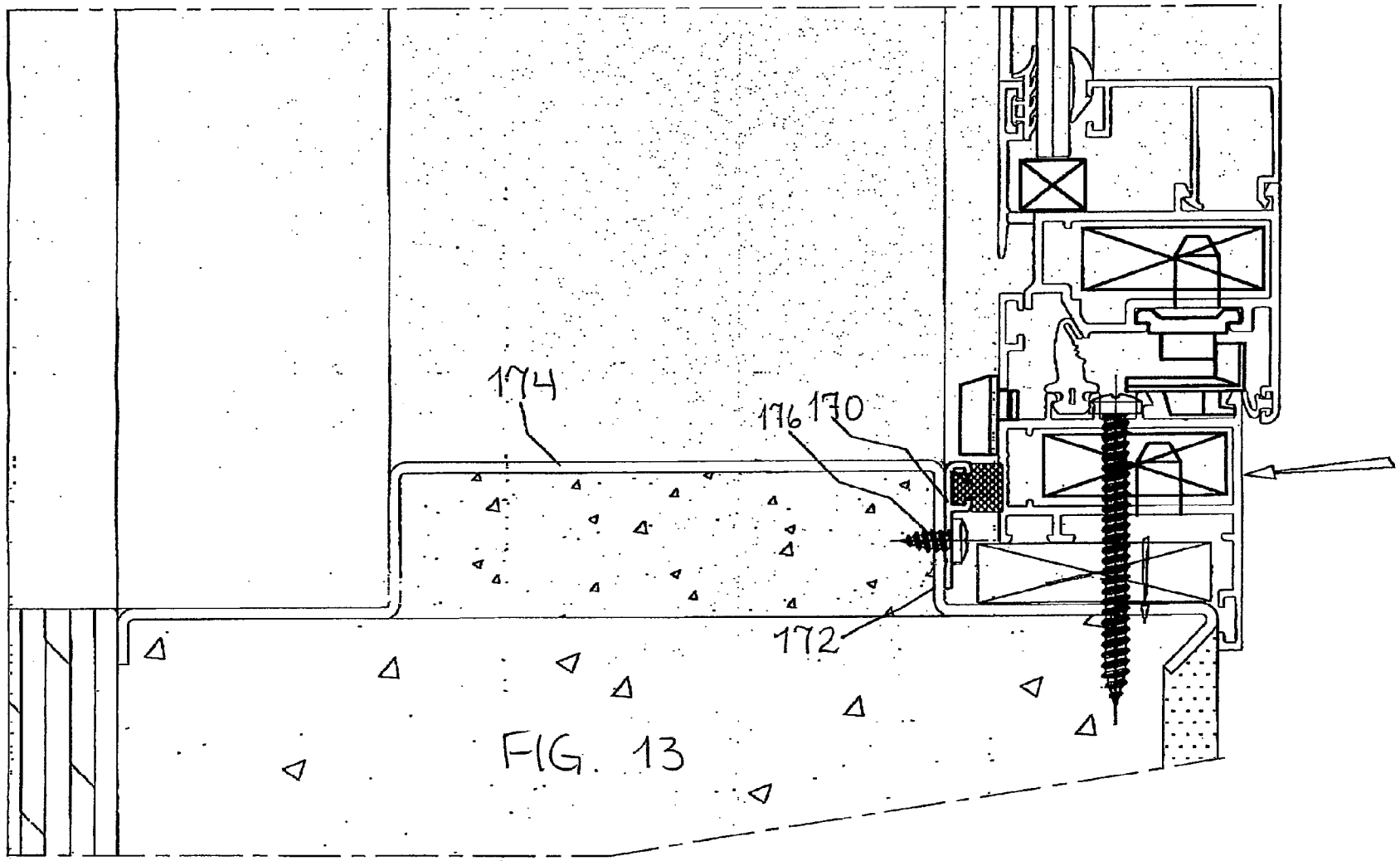
FIG. 13 is a sectional illustration of a window having a blind frame constructed and operative in accordance with a further embodiment of the present invention.

Yet another embodiment is shown in FIG. 13, where a separate, seal-receiving profile 170 is affixed to the stop member 172 of a blind frame 174, as by bolts 176. This arrangement also permits mounting of conventional windows on the blind frame of the present invention with a rubber, rather than silicon, seal between them.

While the accessory compartment has been described above as being part of a blind frame, it can also stand alone, particularly in a prefabricated wall. The accessory compartment includes a housing having an external surface adapted and configured to support an amount of concrete so as to anchor or embed the housing in the wall, as described above.

According to another embodiment of the invention, there is provided a prefabricated wall having at least one window. In this embodiment, a window accessory compartment is provided, which can be anchored in the wall during pre-cast fabrication, in the same fashion described above for a blind frame. Such a pre-cast wall with a built-in window accessory compartment is illustrated in FIG. 14.

Figure 14:
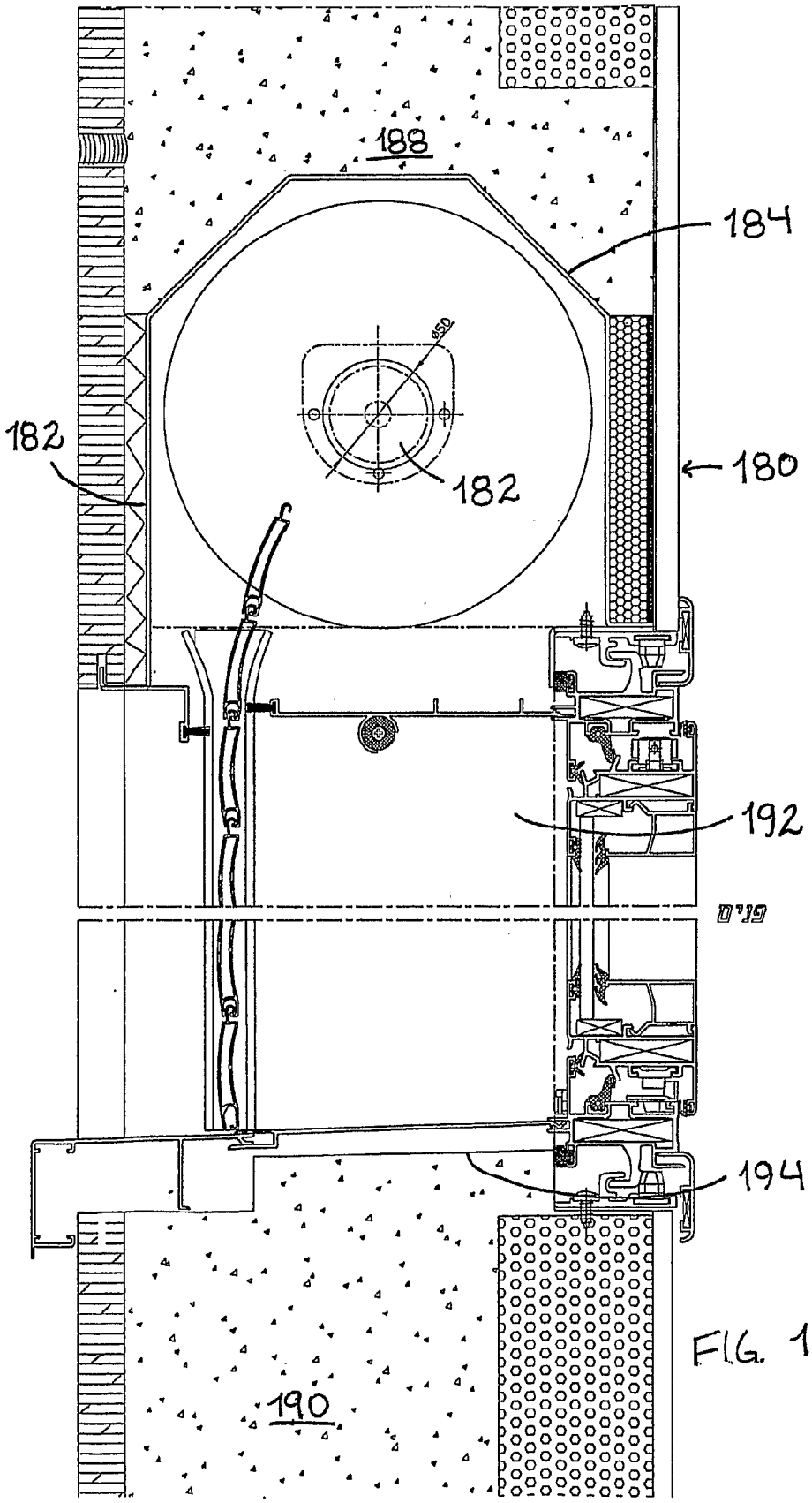
FIG. 14 is a side sectional illustration of a pre-cast wall according to one embodiment of the invention, having a window and a built-in accessory compartment.

FIG. 14 is a side sectional illustration of a pre-cast wall 190 having an accessory compartment 180 according to one embodiment of the invention, mounted in an aperture 192 for mounting a window and an accessory. Accessory compartment 180 includes a housing 182 which is adapted and configured for storing a window accessory (here illustrated as a roller blind 183). Housing 182 is preferably formed of steel or of galvanized sheet metal. Housing 182 includes an external surface 184 adapted and configured to support an amount of concrete 188 so as to anchor or embed the housing in the wall. The housing may be curved and convex, or may have any desired geometric shape. Here, housing 182 is illustrated as being pentagonal in shape. Alternatively, it can be hexagonal, octagonal, round, or of any other desired shape which provides an internal space for storing a window accessory.

It is a particular feature of this embodiment of the invention, that the bottom 194 and side portions of window aperture 192 can be molded to the shape of a blind frame, so as to dispense with the metal profile serving as the blind frame. In this way, only the upper portion, the accessory compartment housing 182, need be formed of metal and affixed in the wall. The window frame profile can then be affixed to the concrete in any suitable fashion, such as by screws.

Figure 15:
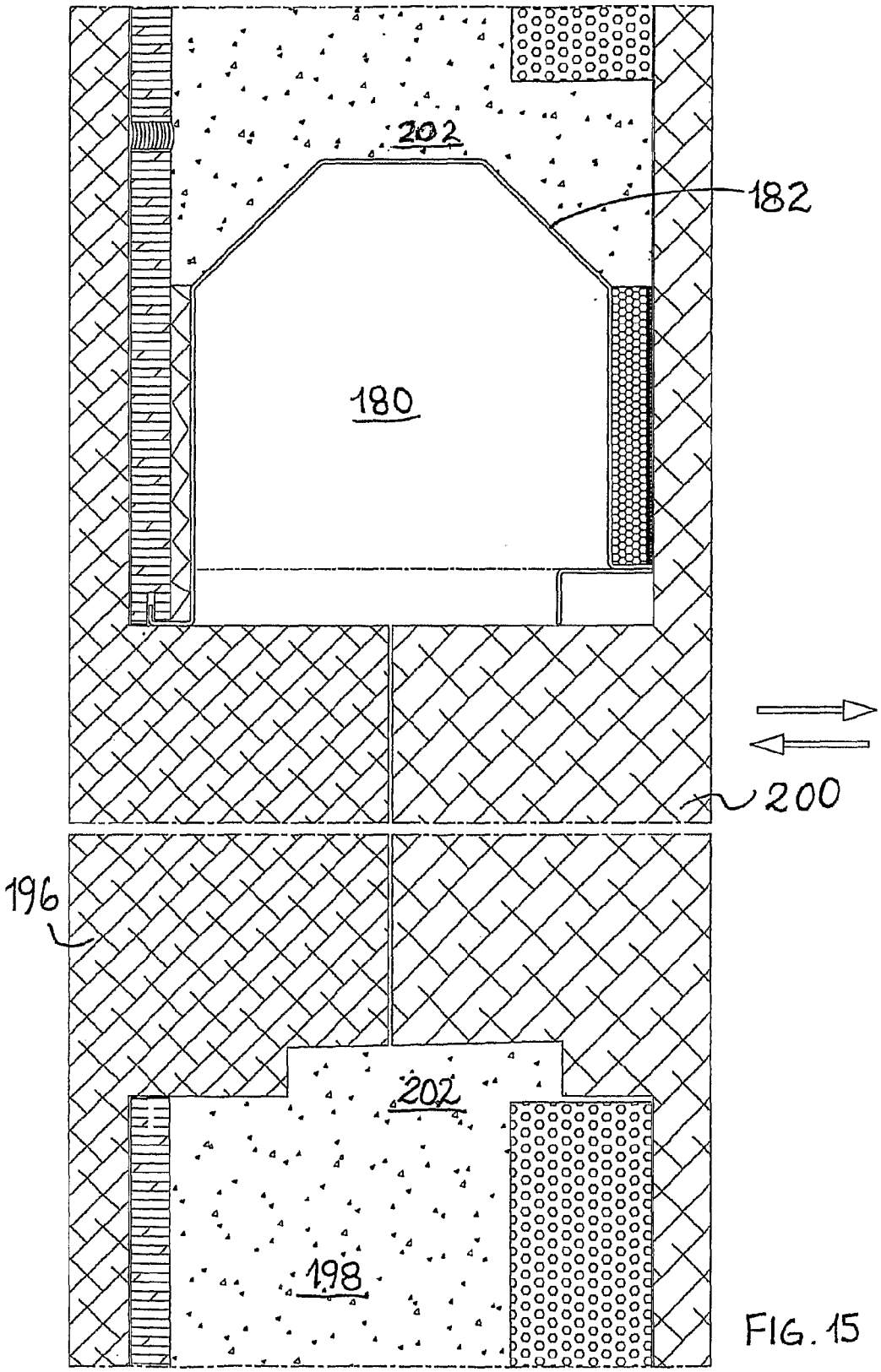
FIG. 15 is a side sectional illustration of the pre-cast wall of FIG. 14 during prefabrication.

FIG. 15 is a side sectional illustration of the accessory compartment 180 of FIG. 14 during prefabrication. A lower portion of a prefabricated wall 198 is prepared, defining a bottom portion of an aperture for a window. A first mold portion 196, preferably formed of steel, of the shape of a portion of the blind frame, is permanently affixed to the prepared lower portion prefabricated wall 198. The housing 182 of an accessory compartment is seated on first mold portion 196, and held in place by a removable mold portion 200, which completes the shape of the blind frame. Insulation material 204, such as Styrofoam, with or without a coating for painting or plaster, can be inserted adjacent the compartment housing inside the mold, if desired. Removable mold portion 200 is affixed to first mold portion 196 in registration therewith, as by screws. Removable mold portion 200 may be made of steel, sheet metal, concrete, plastic, or any other material suitably robust to withstand the pressure of the poured concrete. Concrete 202 is now cast about housing 182 between mold portions 196 and 200 and fills the space above, below and around the window opening. In this manner, the housing 182 is affixed in the cement and the sides and lower portion of the window opening are cast in the shape of a blind frame.

Figure 16:
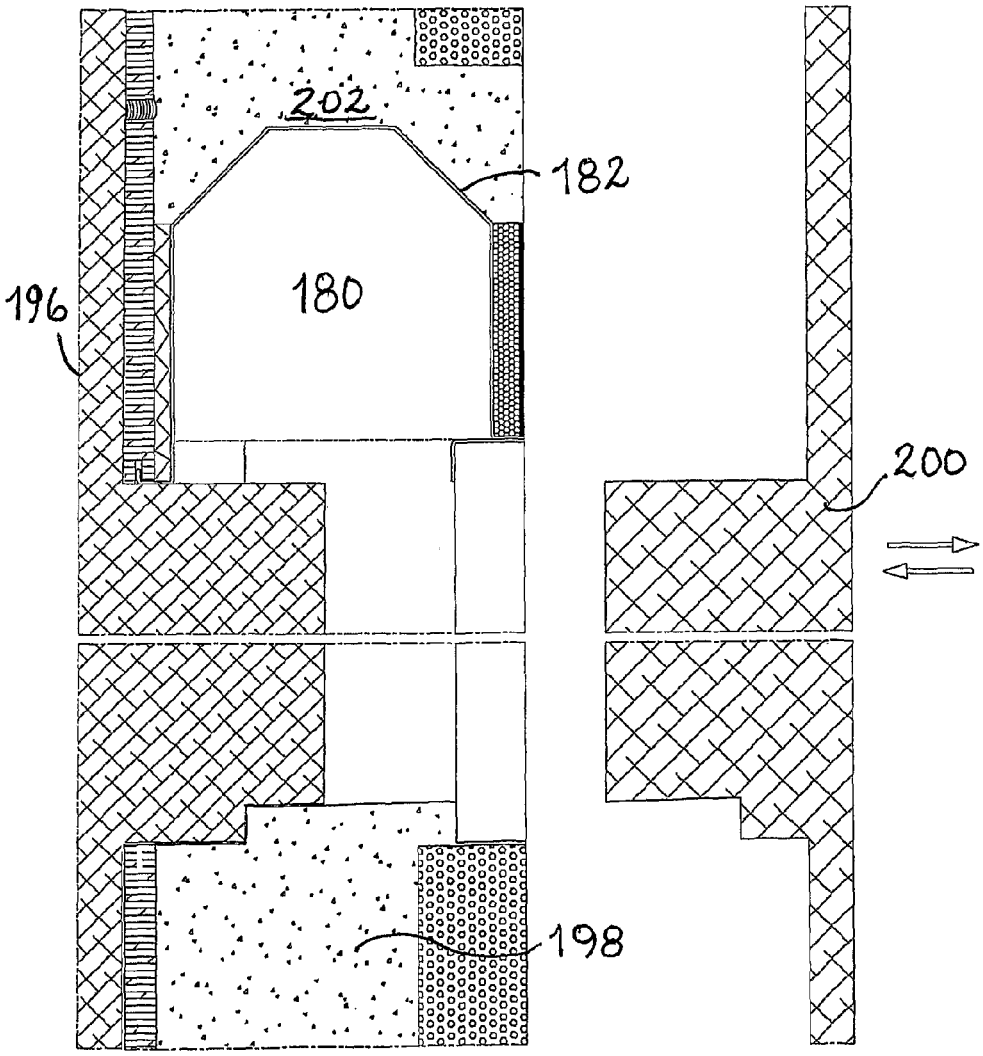
FIG. 16 is a side sectional illustration of the prefabricated wall of FIG. 14 before installation of a window.

Once the concrete has hardened sufficiently, removable mold portion 200 is removed, and the prefabricated wall is ready for mounting on a building, as shown in FIG. 16. A window and corresponding window accessory can now be mounted in the prepared window opening.

While the invention has been described with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims which follow.

The invention claimed is:

1. A blind frame for a window or door, the blind frame comprising:

a profile, having a shoulder, for seating on and affixing to a surface of a wall;

a channel defined by said shoulder, said channel extending at least partially around the periphery of said profile and defining a space between said channel and said wall surface before concrete is poured, said space being sized and shaped to receive an amount of concrete for affixing said channel and said profile to said wall surface;

wherein a portion of said profile includes a plurality of filling apertures opening into said channel for casting concrete through said apertures through said profile.

2. The blind frame according to claim 1, wherein said shoulder defines a stop member configured to engage sealing means on an outer frame of a window or door mounted in the blind frame.

3. The blind frame according to claim 1, wherein a top segment of the frame defines an accessory compartment sized and shaped for storing a window accessory above a window opening, said accessory compartment including an external surface sized to be embedded inside a wall and to support an amount of concrete cast on said surface, and a supporting profile, to which a top profile of a window can be affixed, affixed to said accessory compartment; said external surface including two concrete receiving flanges, one at each end, one flange affixed to said supporting profile, a second flange supporting said accessory compartment on said wall.

4. The blind frame according to claim 1, wherein said profile further includes a second portion for sealingly mounting on said shoulder.

5. A blind frame for a window or door, the frame comprising:

a mounting portion for mounting in a pre-cast wall, wherein at least a portion of said mounting portion of the frame includes a shoulder defining a channel between the frame and said pre-cast wall, said channel being sized and shaped to receive an amount of concrete for affixing said mounting portion to said wall, wherein a portion of said profile includes a plurality of filling apertures opening into said channel for casting concrete therethrough; and a complementary portion including means for sealing engagement with said shoulder after said mounting portion has been mounted in said pre-cast wall.

6. The blind frame according to claim 4, wherein:

said mounting portion includes at least a portion of a top segment defining an accessory compartment for storing a window accessory, the top segment including an external surface sized and shaped to be embedded inside a wall segment and to support an amount of concrete cast onto said external surface; and said complementary portion includes a closure portion for completing said top segment.

7. A method for forming a blind frame for a window or door, the method comprising:

forming a mounting portion of a blind frame to be mounted on a pre-cast wall, said mounting portion having a shoulder defining a channel between said mounting portion and said pre-cast wall before concrete is cast therein, said channel being sized and shaped to receive an amount of concrete for affixing the mounting portion to said wall, a portion of said profile including a plurality of filling apertures opening into said channel for casting concrete therethrough; and forming a complementary interior portion for sealing engagement with said mounting portion for sealingly affixing said complementary interior portion to said mounting portion after said mounting portion has been mounted in said pre-cast wall.

8. An accessory compartment for storing a roller blind, the compartment comprising:

a housing sized to hold a roller blind and be mounted inside a wall;

said housing defining an external concrete-supporting surface for embedding said housing inside said wall;

a supporting profile, to which a window frame can be affixed, affixed to said housing;

said surface including two concrete receiving flanges, one at each end, one flange affixed to said supporting profile, a second flange supporting said housing on said wall; and a roller blind mounted in said housing.

9. The accessory compartment according to claim 7, wherein:

said housing is formed of steel; and said housing has a substantially pentagonal cross section.

10. A method for mounting in a wall an accessory compartment for storing a roller blind, the method comprising:

providing a housing for a roller blind having an external surface, supporting said housing over a window opening in the wall on two flanges extending from said external surface such that a top profile of a window can be affixed thereto;

mounting said housing inside said wall to serve as a support for concrete;

casting concrete inside said wall on said external surface and said flanges, thereby embedding said housing inside said wall; and mounting a roller blind in said housing.

11. The method according to claim 9, wherein said housing has a substantially pentagonal cross section.

* * * * *